US009950526B2

(12) United States Patent
Miyajima

(10) Patent No.: US 9,950,526 B2
(45) Date of Patent: Apr. 24, 2018

(54) LIQUID EJECTING HEAD AND LIQUID EJECTING APPARATUS

(71) Applicant: SEIKO EPSON CORPORATION, Tokyo (JP)

(72) Inventor: Hiroki Miyajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/441,680

(22) Filed: Feb. 24, 2017

(65) Prior Publication Data

US 2017/0253036 A1 Sep. 7, 2017

(30) Foreign Application Priority Data

Mar. 3, 2016 (JP) ..... 2016-040740

(51) Int. Cl.
*B41J 2/14* (2006.01)
*B41J 2/175* (2006.01)
*B41J 2/165* (2006.01)

(52) U.S. Cl.
CPC ..... *B41J 2/1433* (2013.01); *B41J 2/175* (2013.01); *B41J 2/16517* (2013.01)

(58) Field of Classification Search
CPC ..... B41J 2/17523; B41J 2/17563; B41J 2/19; B41J 2/14233
USPC ..... 347/20, 45, 47, 54, 68
See application file for complete search history.

(56) References Cited

FOREIGN PATENT DOCUMENTS

JP 2013-233722 A 11/2013

*Primary Examiner* — An Do
(74) *Attorney, Agent, or Firm* — Foley & Lardner LLP

(57) ABSTRACT

A liquid ejecting head includes: a head body that includes, an ejection surface on which a nozzle that ejects a liquid is provided, an intermediate unit that is provided on an opposite side to the ejection surface and that enables the liquid to flow from a liquid accommodating unit to a flow channel within the head body, a guide channel that guides a portion of the liquid that has leaked from the intermediate unit, a connector that is provided on a first side surface among side surfaces of the head body, a discharge channel that is provided so as to communicate with the guide channel and that discharges the leaked portion of the liquid to a second side surface that is different from the first side surface, and a projecting portion that is provided in the discharge channel and that projects from a bottom surface of the discharge channel.

14 Claims, 11 Drawing Sheets

LIQUID EJECTING HEAD AND LIQUID EJECTING APPARATUS

BACKGROUND

1. Technical Field

The present invention relates to a technique for ejecting a liquid such as ink onto a medium.

2. Related Art

Liquid ejecting apparatuses such as ink jet printers and the like include a liquid ejecting head that introduces a liquid such as ink from a cartridge, supply tube or the like via an intermediate unit (ink introduction needle) and ejects the liquid from a nozzle. In the intermediate unit, leakage of the liquid may occur due to, for example, inferior mounting or malfunction of a cartridge or supply tube. Consequently, various measures have been taken so as to prevent a liquid which has leaked from the intermediate unit from adhering to a circuit board, connector thereof, or the like provided in a liquid ejecting head. For example, in a liquid ejecting head of JP-A-2013-233722, a standing wall is formed around ink introduction needles and a liquid discharge opening is provided at a position that does not interfere with electronic components on an inner portion of the standing wall. Further, on a side-surface side different to that on which the connector is arranged, a discharge channel that cuts through a portion of the standing wall is formed. By doing this, it is possible to discharge a liquid that has not completely discharged from a discharge opening and that has accumulated on the inside of the standing wall from a side surface of the liquid ejecting head without the liquid adhering to the connector.

However, in a structure in which a liquid that has leaked from an intermediate unit is discharged to a side surface of a liquid ejecting head, when fingers grab the side surfaces of the liquid ejecting head, the likelihood of the fingers touching the liquid that has adhered to a discharge channel becomes high. When performing work such as installing the liquid ejecting head on a carriage and installing wiring in the connector using the fingers that the liquid has adhered to, there is a concern that the liquid that has adhered to the fingers may adhere to a circuit board, the connector, or the like.

SUMMARY

An advantage of some aspects of the invention is that it is made difficult for a liquid to adhere to fingers.

A liquid ejecting head according to an aspect of the invention includes a head body that includes an ejection surface on which a nozzle that ejects a liquid is provided, an intermediate unit that is provided on a surface on an opposite side to the ejection surface and that enables the liquid to flow from a liquid accommodating unit to a flow channel within the head body, a guide channel that is provided around the intermediate unit and that guides a portion of the liquid that has leaked from the intermediate unit, a connector that is provided on a circuit board within the head body and that is arranged on a first side surface among side surfaces of the head body, a discharge channel that is provided so as to communicate with the guide channel and that discharges the leaked portion of the liquid to a second side surface that is different from the first side surface among the side surfaces of the head body, and a projecting portion that is provided in the discharge channel and that projects from a bottom surface of the discharge channel. In this case, by providing the discharge channel with the projecting portion, it is made difficult for a finger to touch the liquid of the discharge channel because the finger touches the projecting portion even if the finger is used to grasp a side surface of the head body. Consequently, it is possible to make it difficult for the liquid to adhere to the finger.

According to the aspect, the projecting portion may be arranged along the second side surface and extends up to an edge portion of the second side surface that is on the opposite side to the guide channel. In this case, compared with a case where the projecting portion does not extend up to the edge portion of the second side surface, it becomes difficult for the liquid of the discharge channel to move around to another side surface.

According to the aspect, a groove that guides the leaked portion of the liquid may be formed on one or both of a sidewall of a wall portion that forms the discharge channel and a sidewall of the projecting portion. In this case, it is possible to make it difficult for the liquid that passes through the discharge channel to move around to a surface that is easily touched by a finger because it is guided by the groove formed on the side surface that is difficult for the finger to touch.

According to the aspect, the bottom surface of the guide channel may be provided with a groove or rib that guides the leaked portion of the liquid from the intermediate unit toward the discharge channel. In this case, compared with a case where a groove or rib is not formed, it is easy to guide the liquid that has leaked from the intermediate unit toward the discharge channel.

According to the aspect, the head body is mountable on a carriage that reciprocates and a communication portion may be provided at an end portion of the intermediate unit of the head body in a direction of reciprocation of the carriage, the communication portion communicating with the guide channel. In this case, using the inertial force of the reciprocation of the carriage, it is possible to facilitate the discharge of the liquid from the communication portion of the intermediate unit to the guide channel.

According to the aspect, the discharge channel may be arranged on a side on which the communication portion is provided. In this case, using the inertial force of the reciprocation of the carriage, it is possible to facilitate the discharge of the liquid of the guide channel to the discharge channel.

According to the aspect, a plurality of liquid containers that store the liquid may be provided in the liquid accommodating unit and a plurality of intermediate members that individually correspond to the plurality of liquid containers may be provided in the intermediate unit, the plurality of liquid containers having different liquid storage capacities. Among the plurality of intermediate members, an intermediate member that enables the liquid of a liquid container having a largest liquid storage capacity among the plurality of the liquid containers to flow may be located at the end portion side of the intermediate unit at which the communication portion is arranged. In this case, even if a large amount of liquid begins to leak out from the liquid container with the largest liquid storage capacity, it is possible to facilitate the discharge of the liquid from the communication portion of the intermediate unit to the guide channel without affecting other liquid containers due to the liquid container with the largest liquid storage capacity being near the end portion side at which the communication portion is provided.

A liquid ejecting apparatus according to an aspect of the invention includes the liquid ejecting head according to the above aspect. The liquid ejecting apparatus is, for example, a printer that ejects ink onto a medium such as printing paper, however, the usage of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
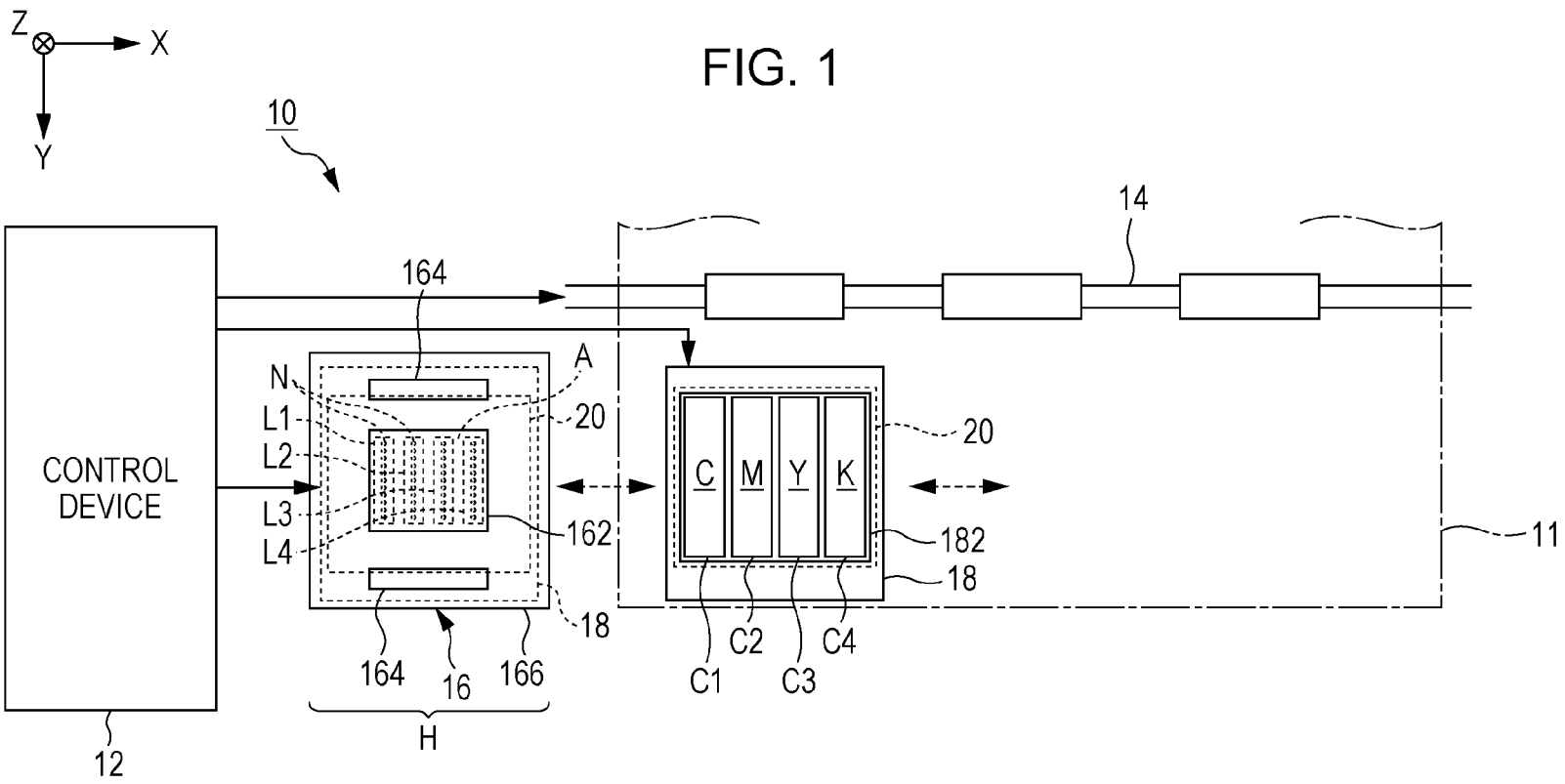
FIG. 1 is a schematic diagram of a liquid ejecting apparatus according to a first embodiment.

FIG. 1 is a partial schematic diagram of a liquid ejecting apparatus 10 according to a first embodiment of the invention. The liquid ejecting apparatus 10 of the first embodiment is an ink-jet-type printing apparatus that ejects ink, which is an example of a liquid, onto a medium 11 such as printing paper. The liquid ejecting apparatus 10 illustrated in FIG. 1 includes a control device 12, a transport mechanism 14, a maintenance unit 16, a carriage 18, and a liquid ejecting head 20. The control device 12 integrally controls each component of the liquid ejecting apparatus 10.

The transport mechanism 14 transports the medium 11 in a Y direction (sub-scanning direction) under the control of the control device 12. The carriage 18 reciprocates in an X direction (main scanning direction) under the control of the control device 12. A desired image is formed on the surface of the medium 11 by the liquid ejecting head 20 ejecting ink onto the medium 11 while the medium 11 is being transported and the carriage 18 is reciprocating. Further, the direction perpendicular to the XY plane (the plane which is parallel to the surface of the medium 11) is hereinafter referred to as the Z direction. The direction of ejection of ink by the liquid ejecting head 20 (downward vertical direction) corresponds to the Z direction.

A liquid accommodating unit 182 (cartridge holder) that accommodates a plurality of liquid containers C1 to C4 (cartridges) that store a plurality of types of ink is provided in the carriage 18. The inks are liquids (color inks) that each contains a color material such as a pigment or dye and are liquids of a total of four colors of, for example, cyan (C), magenta (M) yellow (Y), and black (K). Further, the inks may contain a resin material. The inks of cyan (C), magenta (M), yellow (Y), and black (K) are respectively stored in the liquid containers C1 to C4 of this embodiment. The liquid ejecting head 20 is mounted in a lower portion of the liquid accommodating unit 182 of the carriage 18.

The liquid ejecting head 20 ejects, under the control of the control device 12, each color ink supplied from the liquid containers C1 to C4 onto the medium 11. Four ink nozzle rows L1 to L4 are arranged in the ejection surface (surface facing the medium 11) of the liquid ejecting head 20 illustrated in FIG. 1. In FIG. 1, the ink nozzle rows L1 to L4 of the liquid ejecting head 20 that face the maintenance unit 16 after the carriage 18 has moved to a position above the maintenance unit 16 are shown by dashed lines. Each of the ink nozzle rows L1 to L4 is an assembly of a plurality nozzles N linearly arranged in the Y direction. Further, each of the ink nozzle rows L1 to L4 may be made up of a plurality of rows (for example in a zig-zag arrangement or a staggered arrangement).

Cyan (C) ink supplied from the liquid container C1 is ejected from the nozzles N of the ink nozzle row L1 and magenta (M) ink supplied from the liquid container C2 is ejected from the nozzles N of the ink nozzle row L2. Yellow (Y) ink supplied from the liquid container C3 is ejected from the nozzles N of the ink nozzle row L3 and black (K) ink supplied from the liquid container C4 is ejected from the nozzles N of the ink nozzle row L4.

The maintenance unit 16 is arranged in a non-printing area H that is the home position (standby position) of the carriage 18, for example, in the X direction. The maintenance unit 16 performs maintenance of the liquid ejecting head 20 when the carriage 18 is in the non-printing area H. The maintenance unit 16 includes a cap 162, discharge flow channels 164, and an absorber 166. The cap 162 comes into contact with an ejection surface A of the liquid ejecting head 20 and seals the nozzles N. The maintenance unit 16, for example, seals the ejection surface A by using the cap 162 and sucks up thick ink, bubbles and the like from the nozzles N by using a suction pump (not illustrated) and discharges the aforementioned to the cap 162 in order to stop the nozzles N from becoming blocked.

Figure 2:
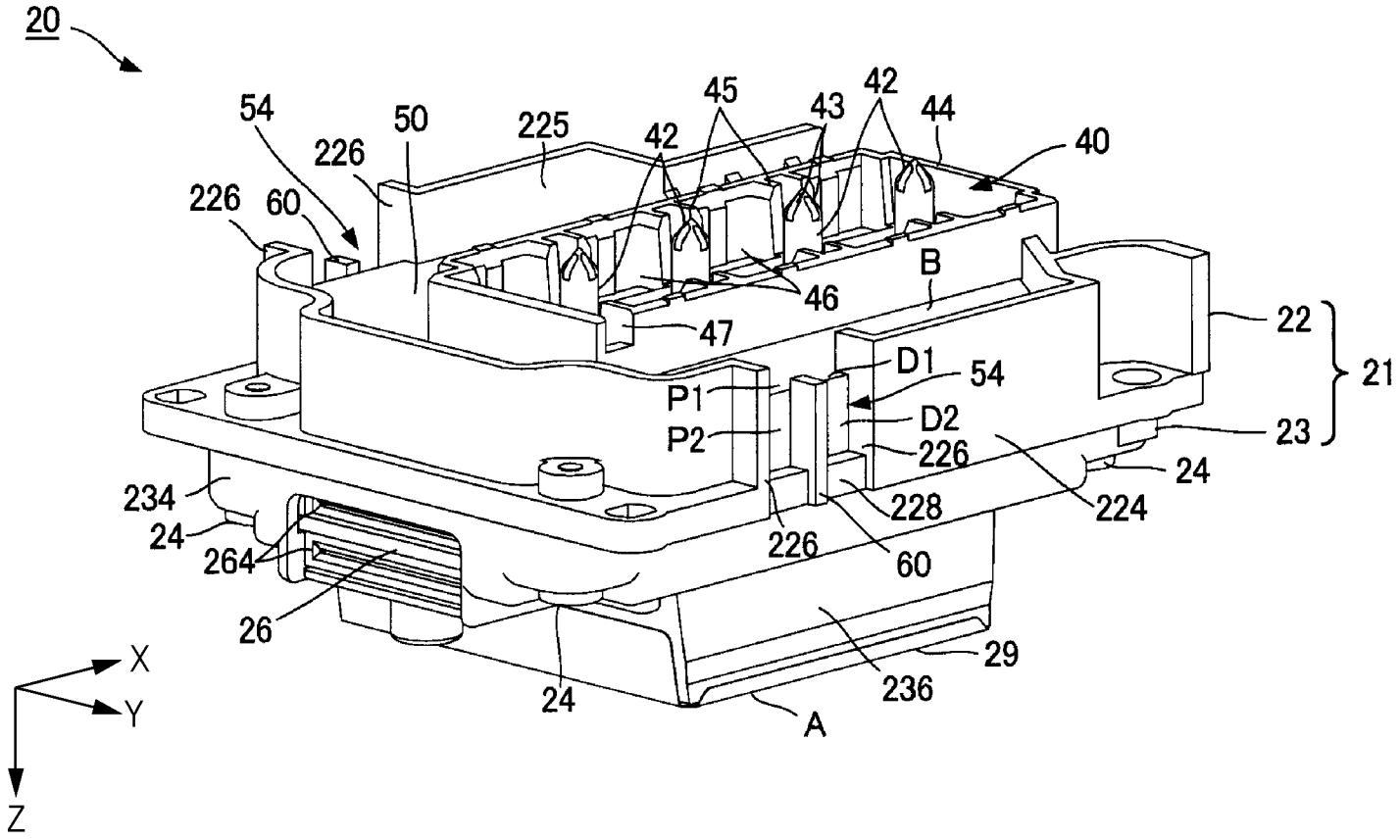
FIG. 2 is an external perspective view of a liquid ejecting head.

The discharge flow channels 164 are flow channels for discharging ink from discharge channels 54 of the liquid ejecting head 20 (described later) to the absorber 166. The cap 162 is provided at a position that corresponds to the ejection surface A of the liquid ejecting head 20 and the discharge flow channels 164 are provided at positions that correspond to the discharge channels 54 of the liquid ejecting head 20. As illustrated in FIG. 2, because the discharge channels 54 of the liquid ejecting head 20 of this embodiment are on both the positive-Y-direction side and the negative-Y-direction side, the discharge flow channels 164 are accordingly arranged on both the positive-Y-direction side and the negative-Y-direction side. Further, the operation of the discharge flow channels 164 and the absorber 166 will be described later.

Figure 3:
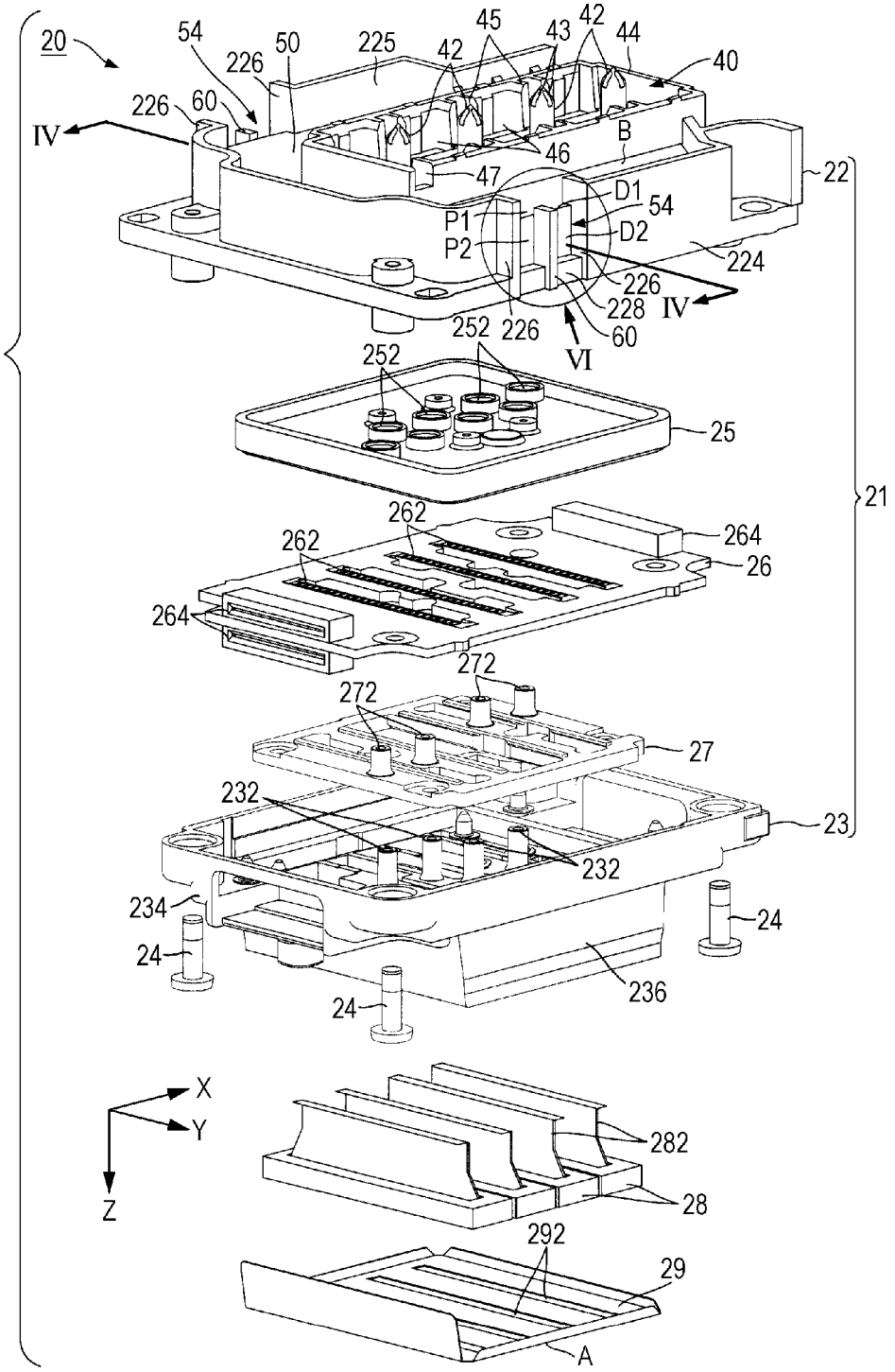
FIG. 3 is an exploded perspective view of the liquid ejecting head.
Figure 4:
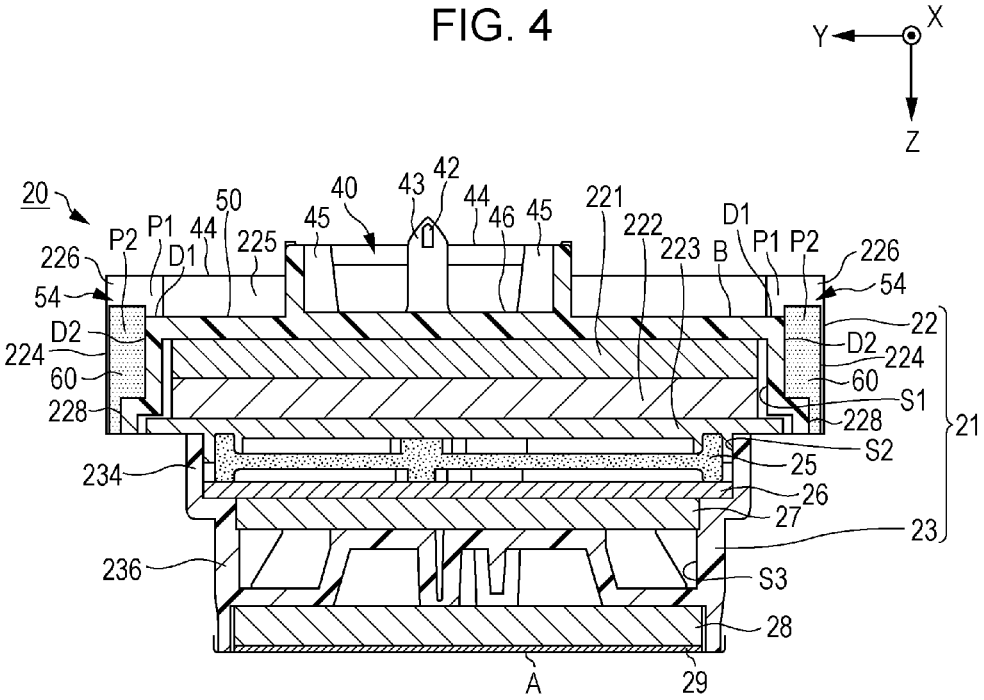
FIG. 4 is a cross-sectional diagram taken along the line IV-IV in FIG. 3.

FIG. 2 is an external perspective view of the liquid ejecting head 20 and FIG. 3 is an exploded perspective view of the liquid ejecting head 20. FIG. 4 is a cross-sectional diagram taken along the line IV-IV (cross section that is parallel to the YZ plane) in FIG. 3. As illustrated in FIGS. 2 and 3, the liquid ejecting head 20 of this embodiment includes a head body 21. The head body 21 accommodates each of the components and is formed in a case member made up of an upstream-side case member 22 and a downstream-side case member 23. The upstream-side case member 22 and the downstream-side case member 23 are, for example, integrally formed by injection molding of a resin material. The upstream-side case member 22 and the downstream-side case member 23 are fixed to each other by using a plurality of screws 24.

As illustrated in FIGS. 3 and 4, a space S1 is formed on the downstream side of the upstream-side case member 22. A space S2 is formed on the upstream side of the downstream-side case member 23 and a space S3 is formed on the downstream side of the downstream-side case member 23. The space S1 of the upstream-side case member 22 communicates with the space S2 of the downstream-side case member 23. Flow channel members 221, 222, and 223 are stacked in the space S1 of the upstream-side case member 22. Ink flow channels (not illustrated) are provided in the flow channel members 221, 222, and 223. A filter (not illustrated) is provided in the middle of the flow channel in the flow channel member 222. Further, the flow channel members 221, 222, and 223 are not illustrated in FIG. 3.

A seal member 25, a circuit board 26, and a flow channel member 27 are stacked in order from the top in the space S2 of the downstream-side case member 23. A plurality of liquid ejecting units 28 (head chips) are accommodated in the space S3 of the downstream-side case member 23 and the space S3 of the downstream-side case member 23 is closed from the bottom by a fixing board 29.

The circuit board 26 is a board that relays drive signals, other control signals and the like sent from the control device 12. Terminals 262 that are electrically connected to wiring boards 282 of respective ones of the liquid ejecting units 28 are formed in the circuit board 26 and connectors 264, other electronic components thereof and the like for connecting to the control device 12 are mounted on the circuit board 26. In the circuit board 26 of this embodiment, four of the terminals 262 corresponding to four of the wiring boards 282 of the liquid ejecting units 28 are formed on an upper surface (negative-Z-direction-side surface) of the circuit board 26. Moreover, wiring members such as flexible flat cables (FFCs) are connected to the connectors 264 so that the circuit board 26 receives drive signals from the control device 12 via the FFCs. The connectors 264 of the circuit board 26 of this embodiment are arranged so as to be exposed from openings of a sidewall 234 of the downstream-side case member 23 on both the positive-X-direction side and the negative-X-direction side of the sidewall 234.

The flow channel member 27 is a tabular member in which ink flow channels are formed. The periphery of the seal member 25 functions as an annular seal portion that has an increased thickness in both the up vertical direction and the down vertical direction. A plurality of flow channels 232 and 272 that project upwards are formed in each of the downstream-side case member 23 and the flow channel member 27. The flow channels 232 pass through corresponding through holes formed in the flow channel member 27 and the circuit board 26 and communicate with the flow channels of the flow channel members 221, 222, and 223 via through holes 252 of the seal member 25. The flow channels 272 pass through corresponding through holes formed in the circuit board 26 and communicate with the flow channels of the flow channel members 221, 222, and 223 via the through holes 252 of the seal member 25. Ink is introduced to the liquid ejecting units 28 via the flow channels 232 and 272.

In the lower end of the downstream-side case member 23, a frame body 236 that is tubular and that forms a space that accommodates the liquid ejecting units 28 is formed so as to project downward (positive-Z-direction side). In this embodiment, four liquid ejecting units 28 that correspond to four of the ink nozzle rows L1 to L4 are arranged side by side in the frame body 236 in the X direction (main scanning direction) that is perpendicular to the transport direction of the medium 11. A nozzle plate (not illustrated), on which a plurality of the nozzles N of the ink nozzle rows L1 to L4 are formed, is formed on a lower surface of the liquid ejecting units 28. Each of the liquid ejecting units 28 includes a plurality of pressure chambers and a plurality of piezoelectric elements (not illustrated) that correspond to various nozzles N. A corresponding one of the wiring boards 282 is mounted on each of the liquid ejecting units 28. The wiring boards 282 of the liquid ejecting units 28 are connected to the terminals 262 of the circuit board 26. The piezoelectric elements vibrate in accordance with a drive signal supplied from the control device 12 via the circuit board 26 and the wiring boards 282. By causing the piezoelectric elements to vibrate thereby changing the pressure inside the pressure chambers, ink in the pressure chambers is ejected from the nozzles N of the nozzle plate.

The fixing board 29 is a tabular member. Each of four openings 292 having a shape (a rectangular shape that is long in the Y direction) corresponding to each of the nozzle plates of the liquid ejecting units 28 is formed in the fixing board 29 for a corresponding one of the liquid ejecting units 28. When the nozzle plates are positioned on the inside of the openings 292, each of the liquid ejecting units 28 is, for example, adhesively fixed on the upper surface (negative-Z-direction-side surface) of the fixing board 29. By doing this, each of the ink nozzle rows L1 to L4 is arranged inside a corresponding one of the openings 292. Further, the liquid ejecting head 20 may have a structure that does not include the fixing board 29. In this embodiment, a case where the fixing board 29 is provided is exemplified; however, the structure is not limited to this and may be a structure that does not include the fixing board 29. In the case where the fixing board 29 is provided, the lower surface (positive-Z-direction-side surface) of the fixing board 29 becomes the ejection surface A and in the case where the fixing board 29 is not provided, the lower surface (positive-Z-direction-side surface) of the nozzle plate becomes the ejection surface A.

Figure 5:
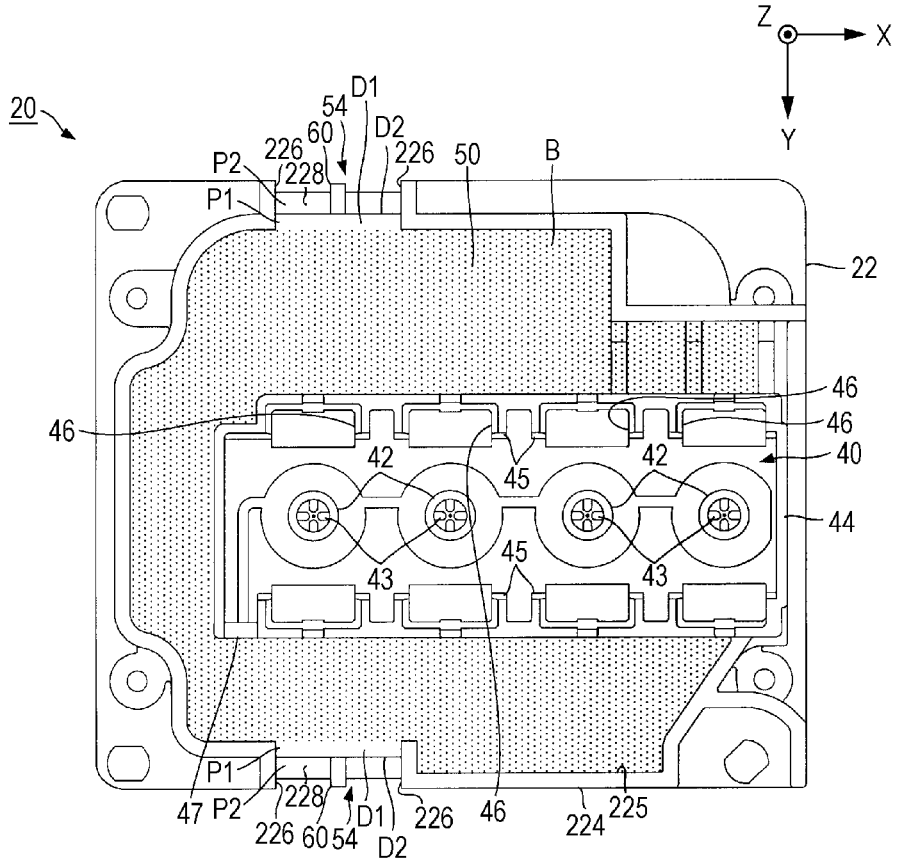
FIG. 5 is a plan view of the liquid ejecting head as seen from above.

FIG. 5 is a plan view of the liquid ejecting head 20 as seen from above (Z direction). As illustrated in FIGS. 3 to 5, an intermediate unit 40 that enables ink to flow from the liquid containers C1 to C4 to flow channels in the upstream-side case member 22 is provided on the upper surface (the surface on the opposite side to the ejection surface A) of the upstream-side case member 22. The intermediate unit 40 is provided with a plurality of ink introduction needles 42 (intermediate members) that are erected on the upper surface of the upstream-side case member 22 and is provided with a surrounding wall 44 that surrounds the periphery of the ink introduction needles 42. In this embodiment, a total of four of the ink introduction needles 42 that correspond to the liquid containers C1 to C4 of four colors are arranged side by side along the X direction (the main scanning direction) that is perpendicular to the transport direction of the medium 11.

The ink introduction needles 42 are hollow needle-shaped members that are inserted in the liquid containers C1 to C4. Introduction holes 43 are formed so as to open at the tips of the ink introduction needles 42. The introduction holes 43 communicate with the flow channels inside the flow channel members 221, 222, and 223. The introduction holes 43 introduce ink that is inside the liquid containers C1 to C4 from the flow channels 232 of the downstream-side case member 23 and the flow channels 272 of the flow channel member 27 to each of the liquid ejecting units 28 via the flow channels inside the flow channel members 221, 222, and 223.

The intermediate unit 40 is partitioned into four cartridge placement areas 46 that are arranged side by side in the X direction by ribs 45 that are provided on the inner side of the surrounding wall 44 and the ink introduction needles 42 are each erected in a corresponding one of the cartridge placement areas 46. Moreover, the liquid containers C1 to C4 are installed in the cartridge placement areas 46.

A guide channel 50 that guides ink that has leaked from the intermediate unit 40 is provided around the intermediate unit 40. In FIG. 5, the guide channel 50 is indicated by a dotted region. A communication portion 47 that communicates with the guide channel 50 is formed in the surrounding wall 44 of the intermediate unit 40. The communication portion 47 of this embodiment is an opening that has been formed in the surrounding wall 44. By forming the communication portion 47 in the intermediate unit 40, ink that has leaked out from the intermediate unit 40 is easily discharged to the guide channel 50 via the communication portion 47.

The guide channel 50 of this embodiment is formed of a space bounded by the upper surface of the upstream-side case member 22, the inner surface of a sidewall 224 of the upstream-side case member 22, and the outer surface of the surrounding wall 44. In detail, as illustrated in FIG. 2, the sidewall 224 of this embodiment has an extending portion 225 that extends higher than the bottom surface B of the guide channel 50 and the guide channel 50 is formed by a space bounded by the inner surface of the extending portion 225, the outer surface of the surrounding wall 44, and the upper surface of the upstream-side case member 22. By doing this, the portion of the upper surface of the upstream-side case member 22 that is bounded by the inner surface of the extending portion 225 and the outer surface of the surrounding wall 44 becomes the bottom surface B of the guide channel 50.

Further, the guide channel 50 is not limited to the above-described structure and may be a groove formed in the upper surface of the upstream-side case member 22. In this case, the sidewall 224 may or may not be provided with the extending portion 225. In this case, the bottom surface of the groove that forms the guide channel 50 becomes the bottom surface B of the guide channel 50. By providing the extending portion 225 of the sidewall 224 that forms the guide channel 50 as in this embodiment, compared with a case where the extending portion 225 of the sidewall 224 is not provided, more ink can be accommodated in the guide channel 50.

The guide channel 50 communicates with the discharge channels 54 that discharge ink that has leaked from the intermediate unit 40 to the side surfaces of the head body 21. The discharge channels 54 are provided on side surfaces that are different to the side surfaces on which the connectors 264 of the circuit board 26 are provided. That is, assuming that the side surfaces on which the connectors 264 are provided are first side surfaces and the side surfaces on which the discharge channels 54 are provided are second side surfaces then the first side surfaces and the second side surfaces are different side surfaces. Specifically, as illustrated in FIG. 5, the discharge channels 54 of this embodiment are provided on both the positive-Y-direction side and the negative-Y-direction side of the sidewall 224 of the upstream-side case member 22. In contrast, the connectors 264 are provided on both the positive-X-direction side and the negative-X-direction side of the sidewall 234 of the downstream-side case member 23. In this way, by arranging the discharge channels 54 on side surfaces different to the side surfaces on which the connectors 264 are provided, it is possible to avoid adherence of ink, which has been discharged from the discharge channels 54, to the connectors 264.

Figure 6:
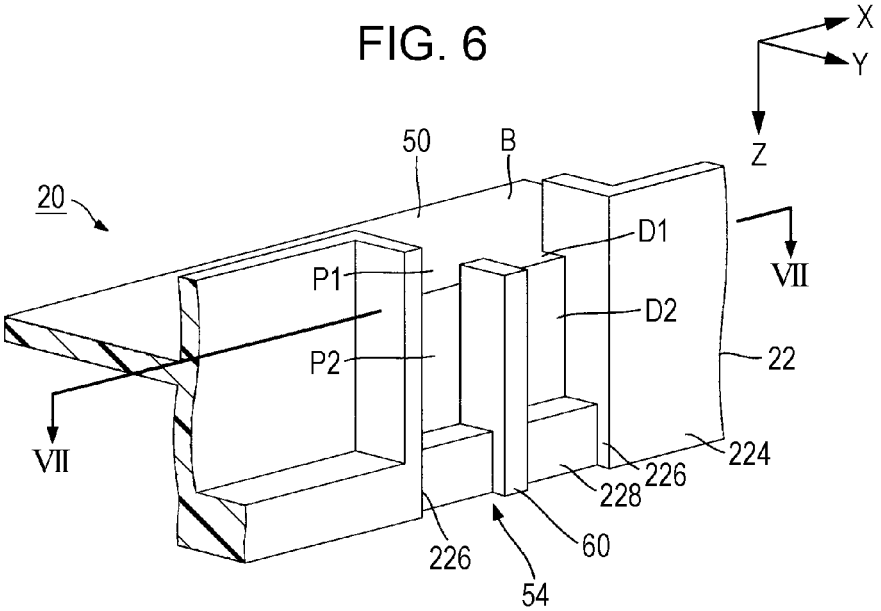
FIG. 6 is a diagram for explaining the structure of a discharge channel and is an enlarged diagram of region VI in FIG. 3.
Figure 7:
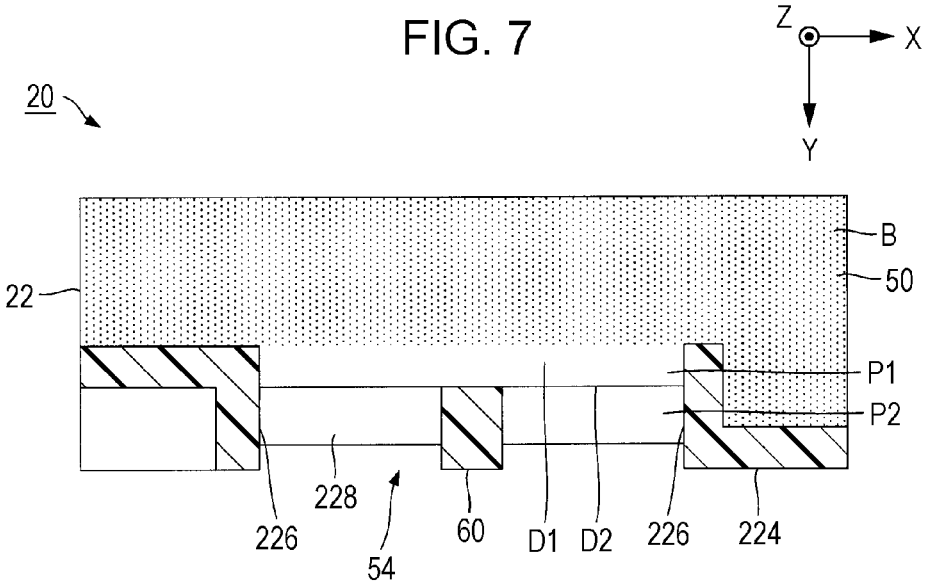
FIG. 7 is a cross-sectional diagram taken along the line VII-VII in FIG. 6.

Here, the structure of the discharge channels 54 of this embodiment will be described. Because the discharge channels 54 have the same structure, here, description will be made for only the discharge channel 54 on the positive-Y-direction side. FIG. 6 is a diagram for explaining the structure of the discharge channel 54 and is an enlarged diagram of a region VI in FIG. 3. FIG. 7 is a cross-sectional diagram (cross section that is parallel to the XY plane) taken along the line VII-VII in FIG. 6. As illustrated in FIGS. 6 and 7, the discharge channel 54 of this embodiment is formed by making an opening in the sidewall 224 of the upstream-side case member 22. Specifically, the discharge channel 54 is formed of a flow channel P1 that communicates with the guide channel 50 in the horizontal direction (Y direction) and a flow channel P2 that communicates with the flow channel P1 and that extends downward in a perpendicular direction (Z direction) along the sidewall.

End portions of the sidewall 224 in the positive-X-direction side and the negative-X-direction side that form the opening are bent along the Z direction and the inner surfaces of wall portions 226 that form these bent portions form the side surfaces of the flow channel P1 and the flow channel P2. As illustrated in FIG. 7, the wall portion 226 on the negative-X-direction side bends toward the positive-Y-direction side and the wall portion 226 on the positive-X-direction side bends toward the negative-Y-direction side. Further, the wall portions 226 may be bent in the same direction (only toward the positive-Y-direction side or only toward the negative-Y-direction side).

The bottom surface D1 of the flow channel P1 of the discharge channel 54 is a portion of the upper surface of the upstream-side case member 22, that is, a surface bounded by both ends of the wall portions 226 within the upper surface of the upstream-side case member 22. The bottom surface D2 of the flow channel P2 of the discharge channel 54 is a portion of the side surface of the upstream-side case member 22, that is, is a surface that is bounded by both ends of the wall portions 226 within the side surface of the upstream-side case member 22. In this embodiment, both the bottom surface D1 of the flow channel P1 of the discharge channel 54 and the bottom surface B of the guide channel 50 are formed on the upper surface of the upstream-side case member 22, even though a case where they have the same height has been exemplified, the structure is not limited to this, by making the bottom surface D1 of the flow channel P1 of the discharge channel 54 lower than the bottom surface B of the guide channel 50, the ink may be easily discharged. At the lower end of the flow channel P2 of the discharge channel 54 a step portion 228 that projects toward the positive-Y-direction side from the bottom surface D2 of the flow channel P2 in such a manner as to reduce the width of the flow channel P2 in the Y direction is formed. By providing the step portion 228, when ink flows down along the bottom surface D2 of the flow channel P2, there is an effect such as the step portion 228 acting as an obstruction and suppressing the force of the flow of ink. However, the step portion 228 need not be provided.

In this way, in a structure in which ink that has leaked from the intermediate unit 40 by the discharge channel 54 flows along a side surface different to the side surfaces on which the connectors 264 of the head body 21 are arranged, direct adherence to the connectors 264 of ink flowing down from the discharge channel 54 can be avoided. However, because ink adheres to the bottom surfaces D1 and D2 of the discharge channel 54, in assembly operations and the like, when a finger is used to grasp the side surface of the head body 21, the likelihood of ink adhering to the finger is high. If the finger that has ink adhered thereto comes into contact with the connectors 264 or the like, there is a concern that the ink will adhere to the connectors 264 or the like.

Accordingly, in this embodiment, by providing a projecting portion 60 that projects from the bottom surfaces D1 and D2 of the discharge channel 54 in the discharge channel 54 in such a manner that a finger will come into contact with the projecting portion 60, it becomes difficult for ink of the discharge channel 54 to adhere to the finger. As illustrated in FIGS. 6 and 7, the projecting portion 60 of this embodiment is arranged so as to extend from the negative-Z-direction side to the positive-Z-direction side (vertical direction) on the bottom surface D2 (second side surface) of the flow channel P2 of the discharge channel 54. The end portion of the projecting portion 60 on the negative-Z-direction side extends so as to have a height that is greater than that of the bottom surface B of the guide channel 50. The end portion of the projecting portion 60 on the positive-Z-direction side extends up to the edge portion (edge portion of the lower end of the step portion 228) of the lower end of the bottom surface D2 of the flow channel P2 that is on the opposite side to the guide channel 50.

By providing the discharge channel 54 with the projecting portion 60 such as that described above, even if a finger is used to grasp the side surface of the head body 21 and comes into contact with the projecting portion 60, it is difficult for the ink of the discharge channel 54 to come into contact with the finger. Consequently, it is possible to make it difficult for ink to adhere to a finger. In particular, during arrangement of the connectors 264, when grasping the head body 21 with a finger, the likelihood of the finger grasping the side surface (X-direction side surface) on which the connector 264 is arranged and the side surface (Y-direction side surface) that is perpendicular thereto is high. In this way, in this embodiment in which the discharge channel 54 is provided in a side surface that has a high likelihood of being grasped by a finger, because the likelihood of a finger coming into contact with the discharge channel 54 is particularly high, the effect of preventing ink from adhering to a finger by provision of the projecting portion 60 becomes particularly marked. Further, even though a case where the projecting portion 60 of this embodiment is arranged along the bottom surface D2 of the flow channel P2 of the discharge channel 54 and extends to the edge portion of the lower end thereof is exemplified, the structure is not limited to this and the projecting portion 60 need not extend to the edge portion of the bottom surface D2 of the flow channel P2. Even in such a case, it is difficult for ink to adhere to a finger. However, the projecting portion 60, by extending to the edge portion of the lower end of the flow path P2 of the discharge channel 54 as in this embodiment, compared with a case where the projecting portion 60 does not extend up to the edge portion, can suppress ink from moving around to other portions up to the edge portion. In particular, by forming the step portion 228 that projects from the bottom surface D2 of the flow channel P2 toward the positive-Y-direction side as in this embodiment, as long as the projecting portion 60 does not project up to the edge portion of the step portion 228, there is a concern that ink will move around from the step portion 228 to a portion other than the discharge channel 54. Regarding this point, in this embodiment, because the projecting portion 60 extends up to the edge portion of the step portion 228 it is possible to make it difficult for ink to move around to a portion other than the discharge channel 54.

Figure 8:
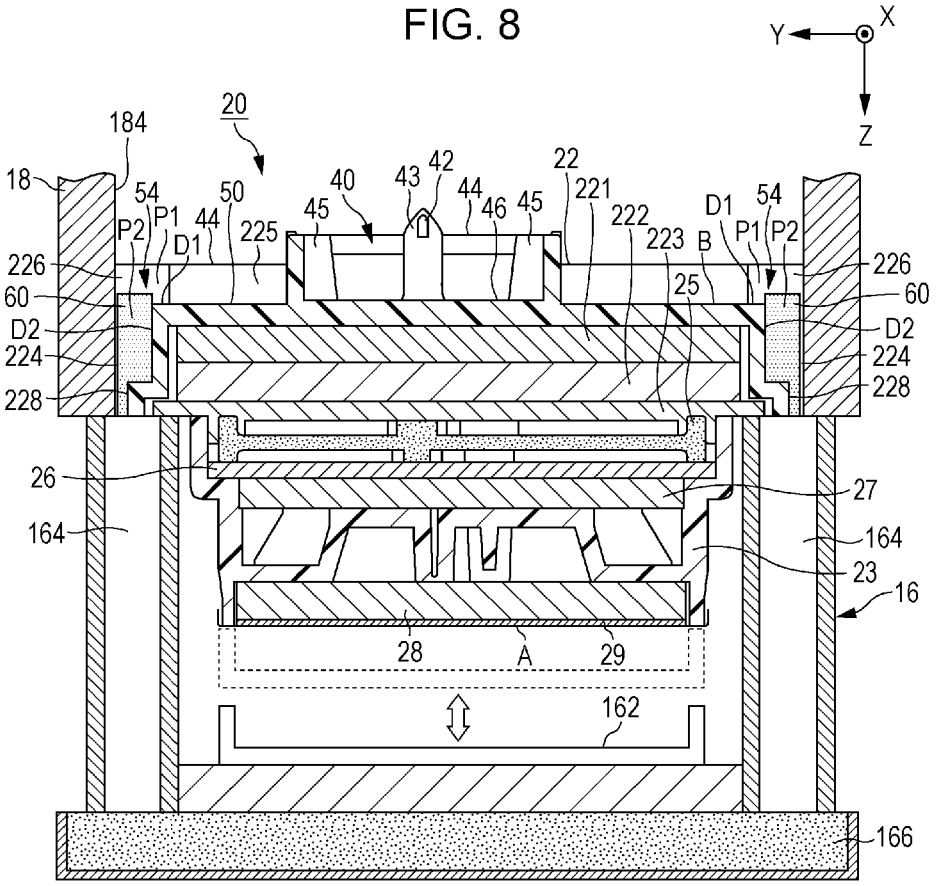
FIG. 8 is a diagram for explaining an operation of the first embodiment.

FIG. 8 is a cross-sectional diagram for explaining an operation in the case where ink from the discharge channels 54 of the liquid ejecting head 20 of this embodiment is discharged to the maintenance unit 16. Further, in FIG. 8, the mechanism that drives the cap 162 and the like have been omitted. As illustrated in FIG. 8, when the carriage 18 on which the liquid ejecting head 20 is mounted moves to a position above the maintenance unit 16 in the non-printing area H, the discharge flow channels 164 are arranged directly below the discharge channels 54. By mounting the liquid ejecting head 20 on the carriage 18, the wall portions 226 of the discharge channels 54 abut against an inner wall 184 of the carriage 18 and close the openings of the flow channels P1 and P2 of the discharge channels 54 in the Y direction. Consequently, it is possible to make ink flowing through the flow channels P1 and P2 of the discharge channels 54 not move around to another portion. The discharge flow channels 164 communicate with the lower end of the flow channel P2 of the discharge channels 54 and the lower end of the discharge flow channels 164 communicates with the absorber 166. Because of this, it is possible to discharge ink from the guide channel 50 to the absorber 166 from the flow channels P1 and P2 of the discharge channels 54 via the discharge flow channels 164 and cause the ink to be absorbed by the absorber 166. Further, when ink is discharged from the discharge channels 54 to the maintenance unit 16, the nozzles N may or may not be sealed by the cap 162.

First Modification of First Embodiment

Figure 9:
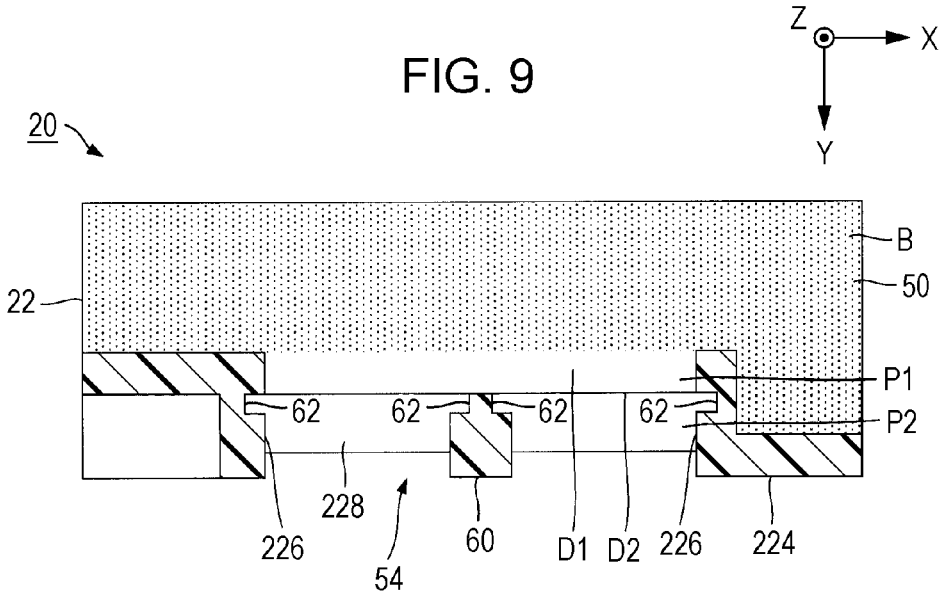
FIG. 9 is a schematic cross-sectional diagram of a discharge channel of a first modification of the first embodiment.

FIG. 9 is a schematic cross-sectional diagram of the discharge channel 54 of the liquid ejecting head 20 according to a first modification of the first embodiment and corresponds to FIG. 7. Elements of each of the modifications given below that have the same operations and functions are designated by the same reference symbols used in the explanation of FIGS. 2 to 8 and detailed description thereof is omitted. As illustrated in FIG. 9, grooves 62 that guide the ink may be formed in both of the side surfaces of the wall portions 226 and the projecting portion 60 that form the discharge channel 54. In this case, it is possible to make it difficult for the ink that passes through the discharge channel 54 to move around to surfaces of the wall portions 226 and the projecting portion 60 that are easily touched by a finger because it is guided by the grooves 62 formed on the side surfaces of the wall portions 226 and the side surfaces of the projecting portion 60 that are easily touched by a finger. Further, the grooves 62 that guide the ink may be formed in any of the side surfaces of the wall portions 226 and the side surfaces of the projecting portion 60.

Second Modification of First Embodiment

Figure 10:
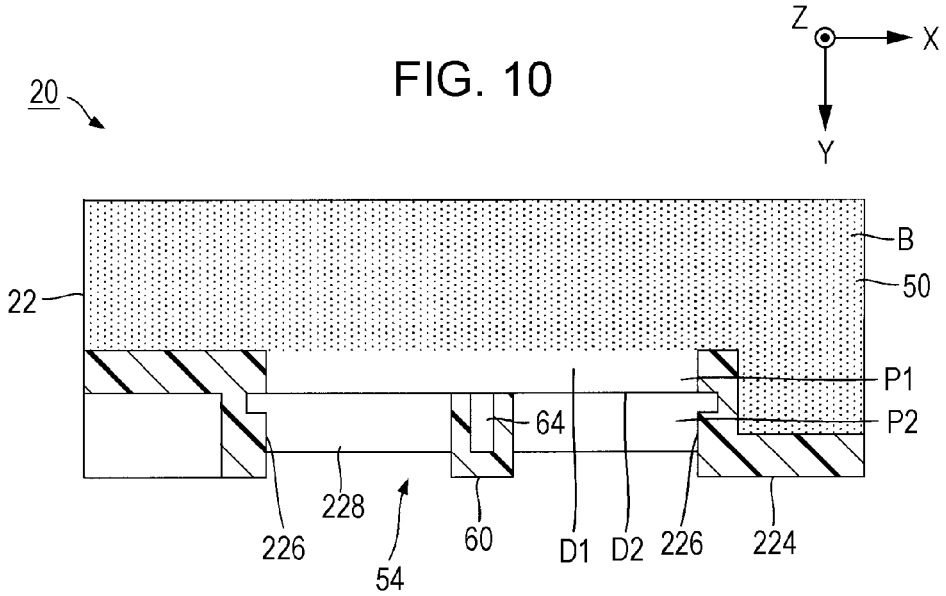
FIG. 10 is a schematic cross-sectional diagram of a discharge channel of a second modification of the first embodiment.

FIG. 10 is a schematic cross-sectional diagram of the discharge channel 54 of the liquid ejecting head 20 according to a second modification of the first embodiment and corresponds to FIG. 7. In FIG. 9, a case where the grooves 62 that guide ink to the side surfaces of the projecting portion 60 is exemplified; however, as illustrated in FIG. 10, a hole 64 that guides ink to an inner portion of the projecting portion 60 may be formed. Consequently, because ink that passes through the discharge channel 54 is guided by the hole 64 that is formed in the inner portion of the projecting portion 60 that is difficult to touch with a finger, it is possible to make it difficult for ink to move around to the surface of the projecting portion 60 that is easily touched by a finger.

Third Modification of First Embodiment

Figure 11:
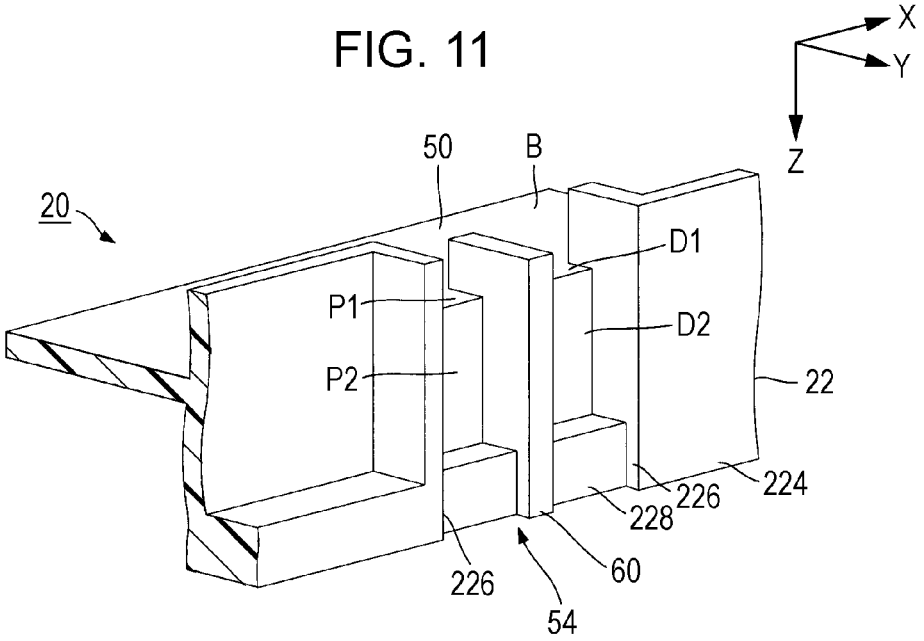
FIG. 11 is an external perspective view of a discharge channel of a third modification of the first embodiment.

FIG. 11 is an external perspective view of the discharge channel 54 of the liquid ejecting head 20 according to a third modification of the first embodiment and corresponds to FIG. 6. A case where the projecting portion 60 of FIG. 6 is formed only on the bottom surface D2 (second side surface) of the flow channel P2 of the discharge channel 54 is exemplified; however, the projecting portion 60 of FIG. 11 is formed not only on the bottom surface D2 of the flow channel P2 of the discharge channel 54 but also on the bottom surface D1 (upper surface of the upstream-side case member 22) of the flow channel P1 of the discharge channel 54. That is, the projecting portion 60 of FIG. 11 is formed so as to enable communication from the bottom surface D1 of the flow channel P1 of the discharge channel 54 to the bottom surface D2 of the flow channel P2. Consequently, by forming the projecting portion 60 so as to span across from the bottom surface D1 of the flow channel P1 to the bottom surface D2 of the flow channel P2, compared with a case where the projecting portion 60 is formed only on the bottom surface D2 of the flow channel P2, it is possible to increase the strength of the projecting portion 60.

Fourth Modification of First Embodiment

Figure 12:
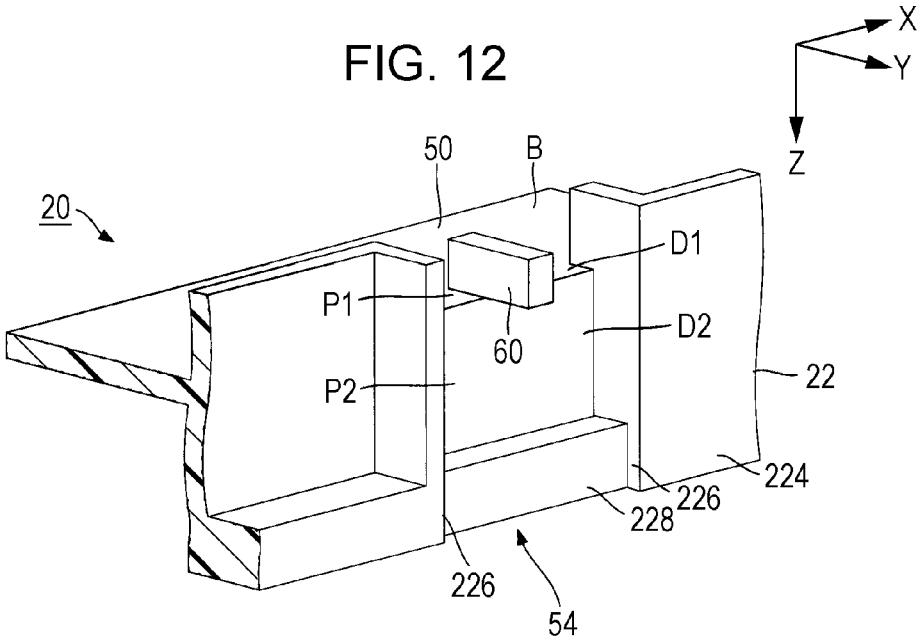
FIG. 12 is an external perspective view of a discharge channel of a fourth modification of the first embodiment.

FIG. 12 is an external perspective view of the discharge channel 54 of the liquid ejecting head 20 according to a fourth modification of the first embodiment and corresponds to FIG. 6. A case where the projecting portion 60 of FIG. 6 is formed only on the bottom surface D2 of the flow channel P2 of the discharge channel 54 is exemplified; however, the projecting portion 60 of FIG. 12 is formed only on the bottom surface D1 of the flow channel P1 of the discharge channel 54. Consequently, even in the case where the projecting portion 60 is formed only on the bottom surface D1 of the flow channel P1 of the discharge channel 54, when a finger is used to grasp the head body 21, it is possible to make it difficult for ink to adhere to the finger. Further, a case where the projecting portion 60 of FIG. 12 projects toward the negative-Z-direction side from the bottom surface D1 of the flow channel P1 of the discharge channel 54 and also projects toward the positive-Y-direction side from the bottom surface D2 of the flow channel P2 is exemplified; however, the structure is not limited to this. For example, as long as the projecting portion 60 of FIG. 12 projects toward the negative-Z-direction side from the bottom surface D1 of the flow channel P1 of the discharge channel 54, it need not particularly project toward the positive-Y-direction side from the bottom surface D2 of the flow channel P2 of the discharge channel 54.

Fifth Modification of First Embodiment

Figure 13:
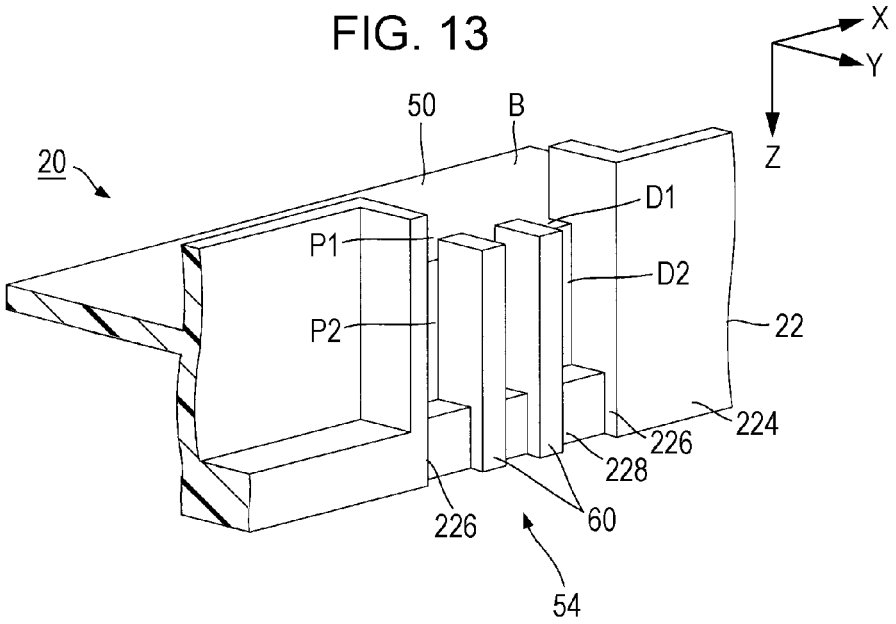
FIG. 13 is an external perspective view of a discharge channel of a fifth modification of the first embodiment.

FIG. 13 is an external perspective view of the discharge channel 54 of the liquid ejecting head 20 according to a fifth modification of the first embodiment and corresponds to FIG. 6. In FIG. 6, a case where a single projecting portion 60 is formed in the discharge channel 54 is exemplified; however, the structure is not limited to this and the projecting portion 60 may be formed in a plurality in the discharge channel 54. In the discharge channel 54 of FIG. 13, two of the projecting portions 60 are formed side by side on the bottom surface D2 of the flow channel P2. Further, the number of the projecting portions 60 may be three or more. As the number of the projecting portions 60 increases it becomes increasingly difficult for the ink of the discharge channel 54 to adhere to a finger.

Second Embodiment

Figure 14:
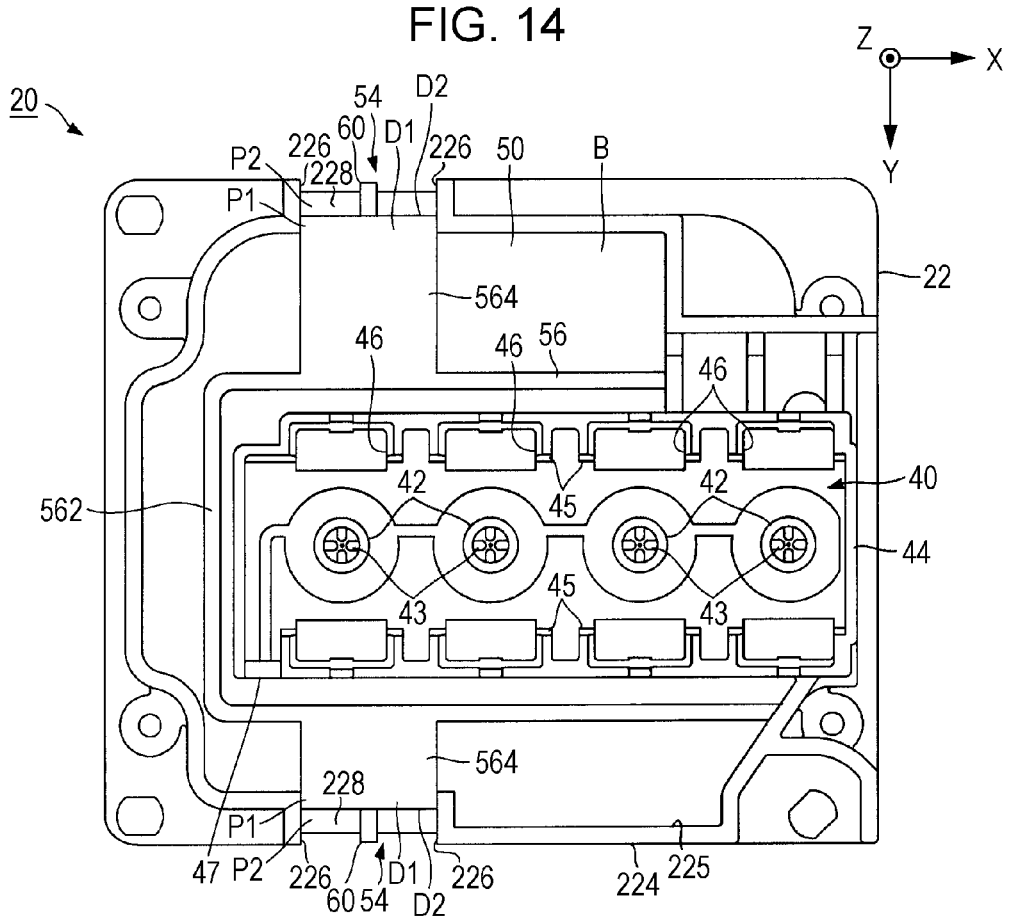
FIG. 14 is a plan view of a liquid ejecting head of a second embodiment as seen from above.

A second embodiment of the invention will be described. Elements of each of the embodiments given below that have the same operations and functions as those of the first embodiment are designated by the same reference symbols as used in the description of the first embodiment and detailed description thereof is omitted. FIG. 14 is a plan view of the liquid ejecting head 20 according to the second embodiment of the invention as seen from above and corresponds to FIG. 5. In the second embodiment, as illustrated in FIG. 14, a groove 56 that guides ink toward the discharge channels 54 from the intermediate unit 40 is further provided in the bottom surface B of the guide channel 50. The groove 56 of FIG. 14 is formed of a surrounding groove 562 that surrounds the intermediate unit 40 and discharge grooves 564 that communicate with the surrounding groove 562 and that extend toward the discharge channels 54 on both the positive Y direction side and the negative Y direction side. In accordance with the structure of the second embodiment, ink that has leaked from the intermediate unit 40 is guided toward the surrounding groove 562 and the discharge grooves 564 and is discharged from either one of the discharge channels 54 on the positive Y direction side and the negative Y direction side. Therefore, compared with a case where the groove 56 such as that described above is not formed, ink that has leaked from the intermediate unit 40 is easily directed to the discharge channels 54. Further, instead of forming the groove 56 in the bottom surface B of the guide channel 50, a rib may be formed. However, in terms of negligibly blocking the flow of ink, the groove 56 is preferable over the rib.

Third Embodiment

Figure 15:
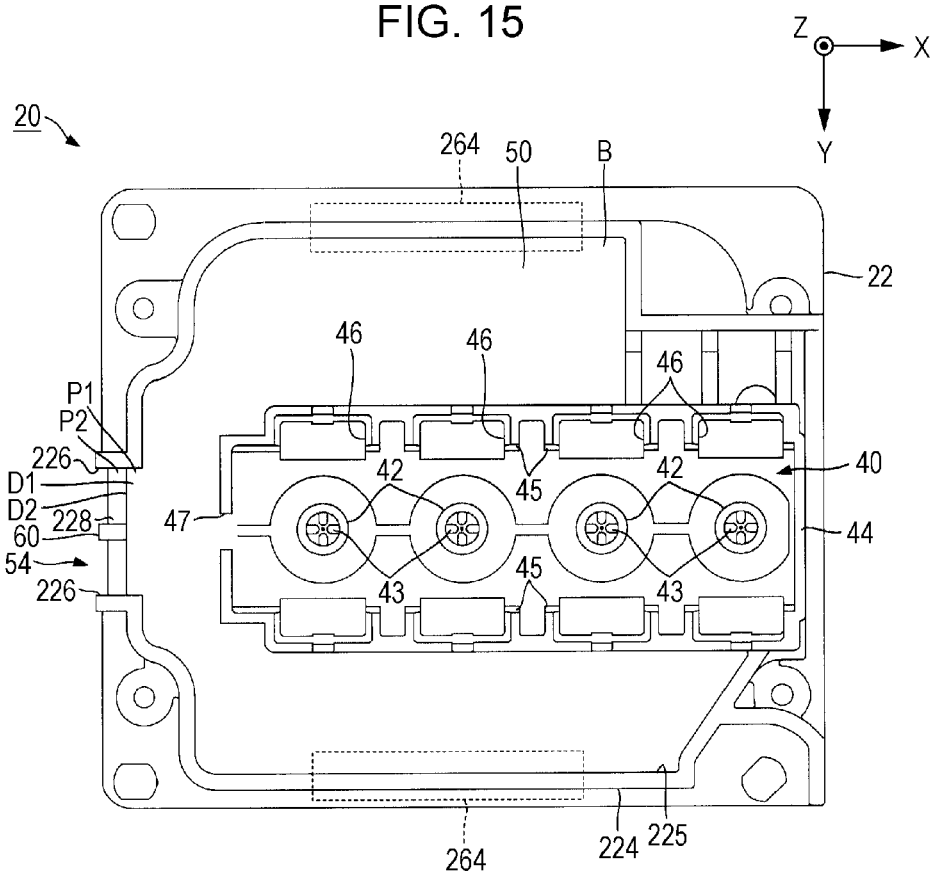
FIG. 15 is a plan view of a liquid ejecting head of a third embodiment as seen from above.

A third embodiment of the invention will be described. FIG. 15 is a plan view of the liquid ejecting head 20 according to the third embodiment as seen from above and corresponds to FIG. 5. In FIG. 5, a case where the communication portion 47 of the intermediate unit 40 and the discharge channels 54 are provided in the Y direction is exemplified: however, the structure is not limited to this. For example, as illustrated in FIG. 15, the communication portion 47 may be provided at the end portion of the intermediate unit 40 in the X direction in which the carriage 18 reciprocates and a single discharge channel 54 may be provided on the same side as the communication portion 47.

In the third embodiment, as illustrated in FIG. 15, the communication portion 47 of the intermediate unit 40 is formed in an end portion of the surrounding wall 44 on the negative-X-direction side and the discharge channel 54 is provided on the same side. In the structure of FIG. 15, the connector 264 is arranged in the positive-Y-direction side and the negative-Y-direction side of the sidewall 234 of the downstream-side case member. In accordance with the structure in FIG. 15, using the inertial force of the reciprocation of the carriage 18, it is possible to facilitate the discharge of the liquid from the communication portion 47 of the intermediate unit 40 to the guide channel 50 and it is possible to further facilitate the discharge of that ink from the guide channel 50 to the discharge channel 54. Further, in FIG. 15, a case where the communication portion 47 of the intermediate unit 40 and the discharge channel 54 are arranged on the negative-X-direction side is exemplified; however the structure is not limited to this and the communication portion 47 of the intermediate unit 40 and the discharge channel 54 may be arranged on the positive-X-direction side, moreover, they may be arranged on both the negative-X-direction side and the positive-X-direction side.

Moreover, in the above-described embodiment, a case is described where the ink storage capacities of the liquid containers C1 to C4 are the same; however, the structure is not limited to this and the ink storage capacities of the liquid containers C1 to C4 may differ. In such a case, for example, in the intermediate unit 40 of FIG. 15, the ink introduction needle 42 of the liquid container that has the largest ink storage capacity among the liquid containers C1 to C4 may be arranged on the end portion side at which the communication portion 47 is provided. For example, in the case where the liquid container C4 of black (K) has the largest ink storage capacity, for example, in FIG. 15, the liquid container C4 of black (K) may be mounted on the end portion side at which the communication portion 47 is provided, that is, on the ink introduction needle 42 on the negative-X-direction side. As a result, even if a large amount of ink leaks out from the liquid container with the largest storage capacity, because it is near the end portion at which the communication portion 47 is provided, it is possible to facilitate discharge of the ink from the communication portion 47 to the guide channel 50 without affecting the other liquid containers. Further, if ink leakage occurs due to damage to the liquid container with the largest storage capacity or the like, because a large amount of ink leaks out, the ink introduction needle 42 of the liquid container with the largest storage capacity may be arranged near the end portion side at which the communication portion 47 is provided.

Further, each modification of the first embodiment may be applied in the second embodiment and the third embodiment and, consequently, the same effect as each modification of the first embodiment can be obtained in the second embodiment and the third embodiment.

Other Modifications

The above-described embodiments can be modified in various ways. Specific examples of the modifications will be described below. Two or more examples arbitrarily chosen from the following examples can be combined appropriately as long as they do not contradict each other.

(1) In each of the above-described configurations, a so-called on-carriage type structure in which the liquid containers C1 to C4 are mounted on the carriage 18 is exemplified; however, the structure is not limited to this and a so-called off-carriage-type structure in which the liquid containers C1 to C4 are mounted on the body of the liquid ejecting apparatus 10 may be applied to the liquid ejecting head 20.

(2) The liquid ejecting apparatus exemplified in each of the above embodiments may be adopted in a printing-only device or any one of various devices such as a facsimile device, a photocopier or the like. However, the use of the liquid ejecting apparatus of this invention is not limited to printing. For example, a liquid ejecting apparatus that ejects a solution of color materials can be used as a manufacturing device for forming the color filters of liquid crystal displays. Moreover, a liquid ejecting apparatus that ejects a solution of conductive materials can be used as a manufacturing device for forming wiring or electrodes of a wiring substrate or the like.

The entire disclosure of Japanese Patent Application No. 2016-040740, filed Mar. 3, 2016 is expressly incorporated by reference herein.

What is claimed is:

1. A liquid ejecting head comprising:

a head body comprising:

an ejection surface at which a nozzle is provided, the nozzle being structured to eject a liquid, an intermediate unit that is provided at a surface on a side opposite the ejection surface, and that is structured to enable the liquid to flow from a liquid accommodating unit to a flow channel within the head body, a guide channel structured to guide a portion of the liquid that has leaked from the intermediate unit, a connector that is provided on a circuit board within the head body and that is arranged on a first lateral surface among lateral surfaces of the head body, a discharge channel that communicates with the guide channel and that is structured to discharge the leaked portion of the liquid to a second lateral surface that is different from the first lateral surface among the lateral surfaces of the head body, and a projecting portion that is provided in the discharge channel and that projects from a bottom surface of the discharge channel.

2. The liquid ejecting head according to claim 1, wherein the projecting portion is arranged along the second lateral surface and extends up to an edge portion of the second lateral surface that is on the opposite side to the guide channel.

3. A liquid ejecting apparatus comprising the liquid ejecting head according to claim 2.

4. The liquid ejecting head according to claim 1, further comprising:

a groove structured to guide the leaked portion of the liquid, the groove being formed on one or both of a sidewall of a wall portion that forms the discharge channel and a sidewall of the projecting portion.

5. A liquid ejecting apparatus comprising the liquid ejecting head according to claim 4.

6. The liquid ejecting head according to claim 1, further comprising:

a groove or rib structured to guide the leaked portion of the liquid from the intermediate unit toward the discharge channel, the groove or rib being provided on the bottom surface of the guide channel.

7. A liquid ejecting apparatus comprising the liquid ejecting head according to claim 6.

8. The liquid ejecting head according to claim 1, further comprising:

a reciprocating carriage on which the head body is mountable; and a communication portion that is provided at an end portion of the intermediate unit of the head body in a direction of reciprocation of the carriage, the communication portion communicating with the guide channel.

9. The liquid ejecting head according to claim 8, wherein the discharge channel is arranged on a side on which the communication portion is provided.

10. A liquid ejecting apparatus comprising the liquid ejecting head according to claim 9.

11. The liquid ejecting head according to claim 8, wherein a plurality of liquid containers that store the liquid are provided in the liquid accommodating unit, a plurality of intermediate members that individually correspond to the plurality of liquid containers are provided in the intermediate unit, wherein, the plurality of liquid containers have different liquid storage capacities, and among the plurality of intermediate members, an intermediate member that enables the liquid of a liquid container having a largest liquid storage capacity among the plurality of the liquid containers to flow is located at the end portion side of the intermediate unit at which the communication portion is arranged.

12. A liquid ejecting apparatus comprising the liquid ejecting head according to claim 11.

13. A liquid ejecting apparatus comprising the liquid ejecting head according to claim 8.

14. A liquid ejecting apparatus comprising the liquid ejecting head according to claim 1.

* * * * *